United States Patent [19]

Storandt

[11] 4,168,083

[45] Sep. 18, 1979

[54] SKI SAFETY BINDINGS INCORPORATING SKI BRAKES

[75] Inventor: Ralf Storandt, Leonberg, Fed. Rep. of Germany

[73] Assignee: Vereinigte Baubeschlagfabriken Gretsch & Co., GmbH, Leonberg, Fed. Rep. of Germany

[21] Appl. No.: 880,496

[22] Filed: Feb. 23, 1978

[30] Foreign Application Priority Data

Feb. 23, 1977 [DE] Fed. Rep. of Germany ..... 2707838

[51] Int. Cl.[2] ..... A63C 7/10

[52] U.S. Cl. ..... 280/605

[58] Field of Search ..... 280/605

[56] References Cited

U.S. PATENT DOCUMENTS 3,909,024 9/1975 Salomon ..... 280/605

FOREIGN PATENT DOCUMENTS 2533465 2/1976 Fed. Rep. of Germany ..... 280/605

2632892 1/1978 Fed. Rep. of Germany ..... 280/605

*Primary Examiner*—Joseph F. Peters, Jr.

*Assistant Examiner*—Milton L. Smith

[57] ABSTRACT

A ski safety binding has a mechanism for deploying a ski brake as soon as the ski boot has left the binding.

Various arrangements of the binding utilize mechanisms to deploy the ski brake which are responsive to both upward movement of the sole clamp following release of the binding, and to downward movement of the sole clamp following the boot pulling out from under the binding.

37 Claims, 17 Drawing Figures

Figure 1:
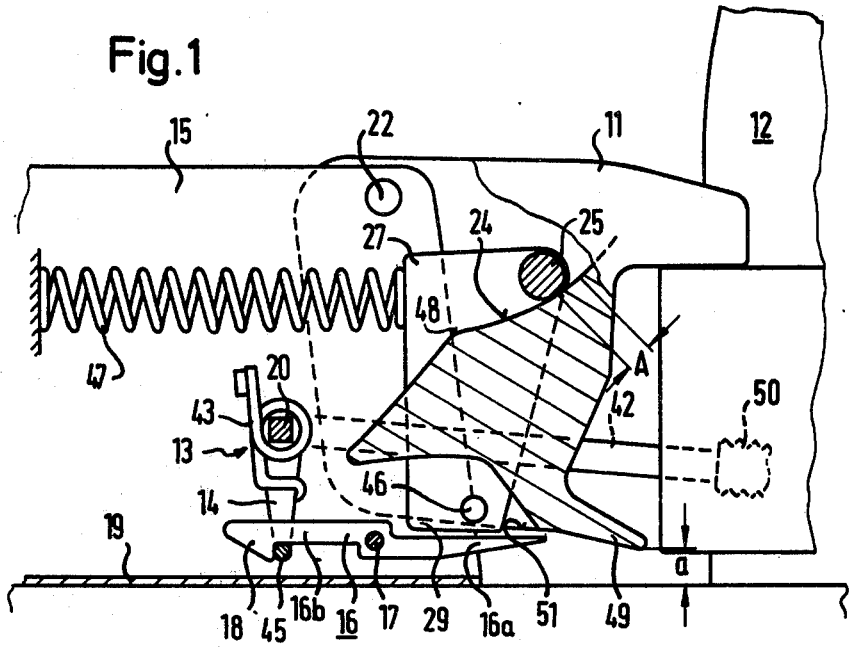

Fig.5
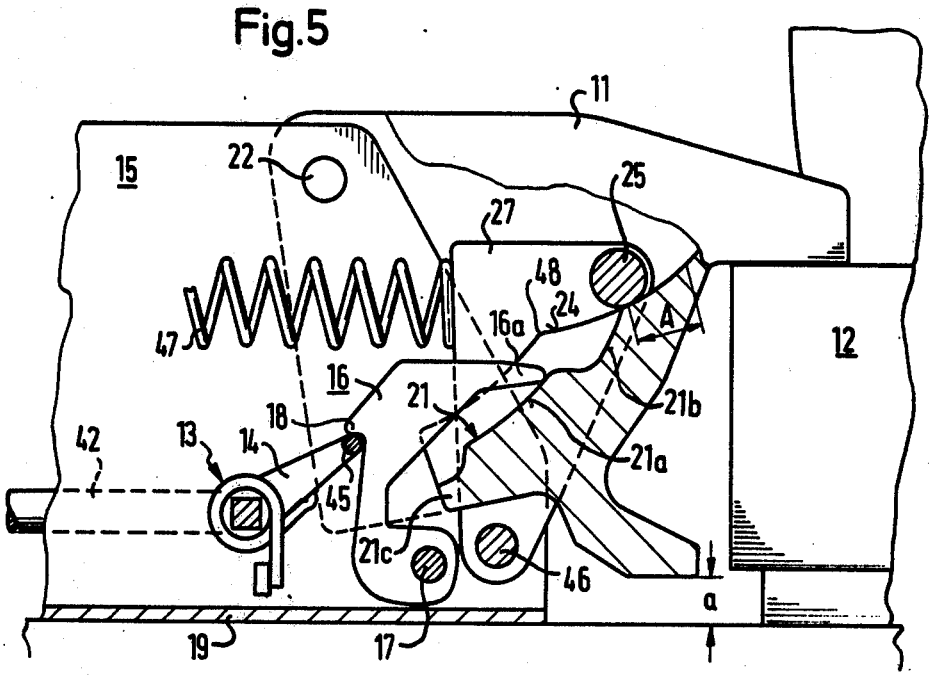
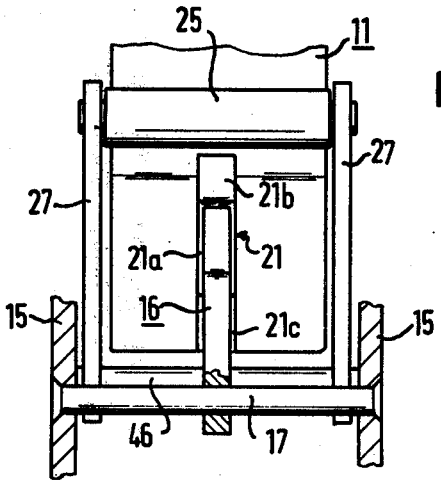
Fig.6

SKI SAFETY BINDINGS INCORPORATING SKI BRAKES

The invention concerns a safety binding for a ski with a clamp for the sole of a boot the sole clamp being pivotally arranged on a base member so as to secure the boot on the ski by a force applied in the closure direction of the clamp and which releases the boot on the occurrence of excessive forces; the binding also having an inbuilt ski brake, with at least one part which can pivot away from the ski, which is normally locked in an inoperative position but which can be deployed to an operative position by the force of a spring following release of the binding.

By integrating a ski brake into such a safety ski binding, especially a heel binding, there arises the problem that the ski brake must be released not only by opening of the sole clamp but also on release of the ski boot by the safety binding at its other end. Generally the sole clamp pivots about a transverse axis and is located at the heel of the boot and the front binding enables the boot to be released to either side.

It must also be ensured that the ski brake functions faultlessly on sideways release of the boot. A ski brake which releases by opening of the sole clamp is already known (DT-OS 1,478,087), however, this brake does not work on the occurrence of a horizontal release of the ski boot at the forward binding (the so called rotating fall).

A further problem lies in the fact that the release of the brake should only take place when the ski boot has actually left the binding. An elastic movement of the parts of the binding, for example brought about by the vertical resilience of the binding permitting partial raising of the heel or by bending of the ski, should not lead to even a partial deployment of the arms of the ski brake. This undesirable occurrence can easily take place when a separately mountable brake is employed in place of the heel rest of an automatic heel binding. Such ski brakes, i.e. of the kind which move due to vertical resilience of the heel binding or through bending of the ski are known (DT-OS 24 08 941 and DT-OS 25 13 188).

The object of the invention is to provide a ski safety binding, especially a heel binding, of the kind previously described which is of relatively simple construction, is economical to manufacture, is reliable in its operation and releases the ski brake when the release point of the sole clamp is exceeded, or when the ski boot is released by operation of the front safety binding, but which remains substantially immovably clamped for so long as the ski boot is retained within the binding and the release point of the binding has not been reached.

For the achievement of this object the invention provides means permitting movement of the sole clamp through at least a predetermined minimum distance beyond its closed position, and mechanism responsive on movement of the ski boot out of the binding to both opening movement of the sole clamp and movement of the sole clamp through said predetermined distance to release the ski brake. The downward movement of the sole clamp is ultimately limited either by contact with the surface of the ski, or by the provision of a mechanical stop within the ski binding itself.

A closing movement of the sole clamp beyond the normal position for clamping the ski boot is thus used, in accordance with the invention, for releasing the ski brake. On the other hand, it is arranged that the ski brake can also begin to move to an operative position when the binding has reached or just exceeded its release point. In this way the ski brake remains in its inoperative position during all normal movements of the skier but is at once released without trouble as soon as either the boot slides out of the sole clamp or the release point of the binding is exceeded.

The tensioning of the ski brake in its inoperative position can be achieved in various ways. The following descriptions of various practical embodiments start from the assumption that the brake is returned by hand to its inoperative position.

All the various kinds of springs can be used to generate the force required to deploy the ski brake to its operative position. All the embodiments are independent of the tensioning and manner of use of these springs. All those parts which move on movement of the sole clamp can be utilised to bring about the release of the ski brake.

According to an especially preferred embodiment the mechanism is a lever mechanism and either a lever already present in the binding or an additional lever can be used.

A preferred practical embodiment is so constructed that a lever pivotally connected to the binding housing is interposed between the sole clamp and a movable arm of the ski brake so that on movement of the sole clamp through the predetermined amount the lever removes the restraint which until then had locked the movable arm of the ski brake.

The arrangement of even a single additional lever requries a construction which can be manufactured economically, which is safe in operation and which, apart from this, is distinguished by requiring little space for its accommodation.

In the simplest case the lever can be directly loaded by the sole clamp as it moves through the predetermined distance and prior to this loading can lock the movable arm of the ski brake. The lever usefully has two arms one of which extends under the sole clamp whilst the other has a latch hook which engages behind the movable arm of the ski brake.

One construction which is especially economical of space is achieved when the lever has the form of a plate. This is true for all embodiments in which the lever can extend over practically the whole width of the binding. In be arranged near to the base of the binding housing, where it takes up the smallest amount of space.

Preferably the lever extends in its normal position generally parallel to the base of the housing, i.e. to the top surface of the ski.

The ski brake is preferably pivotally mounted above the lever. In this case the construction is usefully arranged so that the pivot point is located above the latch hook and the movable arm of the ski brake extends generally downwardly.

A further advantageous practical embodiment of the invention is characterized by cooperation between the lever and a cam track on the sole clamp so that the lever locks the movable arm of the ski brake over a range of movement of the sole clamp but to either side of this range releases the ski brake.

To this end the cam track can usefully have a portion of circular curvature, in which the center of curvature is coincident with the pivot point of the sole clamp. The cam track is then provided, at either end of this central portion, with further portions of the track which are inclined to the central track portion and either rise or fall away therefrom and which give rise to a movement of the lever which releases the ski brake.

In the region of circular curvature the latch does not move at all so that for movement of the sole clamp within the range of vertical resilience of the binding no movement or release of the ski brake can take place.

Preferably the end portions of the cam track rise from the central portion and the lever is biased towards the cam track by a spring. This makes the returning of the ski brake to its inoperative position considerably easier because on resetting movement of the ski brake by hand, the latch lever is automatically raised from the cam track and can snap into engagement with the cooperating part on the movable arm of the ski brake through the use of appropriate inclined faces on the latch lever.

The latch lever is usefully pivoted at its bottom end and the latch hook is on the same side of the latch lever as the projection on the latch lever which engages the cam track.

This embodiment can be used with especial advantage in a ski safety binding in which there is a release cam track on the sole clamp and a spring loaded follower which bears on this cam track.

In this connection the invention provides for the cam track for the ski brake latch lever to be provided in the form of a groove like depression in the release cam track.

The projection on the ski brake latch lever is then usefully constructed to be sufficiently narrow that it fits into the groove and the follower is made sufficiently wide that it bridges the groove.

In this manner two cam tracks are provided in one and the same element so that a very economically manufactured and compact construction is attained. The projection of the ski brake latch lever is advantageously arranged beneath the follower.

In a ski safety binding in which there is a release cam track on the sole clamp and a follower mounted on a pivoted carrier the inventive concept can be brought to a practical embodiment by providing two projections on the carrier one of which operates the latch lever after the sole clamp has travelled through the predetermined additional distance and the other of which is operative once the release point of the binding has been exceeded.

In this way the movement of the carrier is used to release the ski brake in both cases. For this embodiment the latch lever is usefully constructed as was originally described.

The invention can also be used in a ski safety binding in which a toggle release mechanism is used between the sole clamp and the binding housing. In this case one of the toggle levers can have two projections which cooperate with the latch lever so that one of the projections moves the latch lever after the sole clamp has moved through the predetermined additional distance and the other projection moves the latch lever after the release point of the binding has been exceeded. The latch lever in this case also usefully incorporates the constructional features of the first embodiment but can also be constructed as a cranked lever.

The invention can also be used in a ski safety binding in which there is a release cam track on the sole clamp and in which the follower which bears on the cam track is carried on a pivoted carrier spring urged towards the cam track or by a spring loaded piston displaceable in the longitudinal direction of the ski. In this case the movable arm of the ski brake can lie directly on supports provided on the carrier or the piston, the supports having narrow seating surfaces so that the movable arm is released either through normal release when the release point of the binding has been exceeded or by movement of the sole clamp through the predetermined distance. This embodiment is characterized by its especial simplicity; no measures, other than the provision of supports on the carrier or the piston, are necessary for securing and releasing the ski brake at the appropriate time.

A further embodiment is characterized by a sole clamp having a pivotally mounted part and a second part which actually clamps the sole of the ski boot and which is spring loaded and vertically movable through the predetermined distance relative to the first pivoted part. In this manner the vertically movable part is held in its uppermost position when the ski boot is in place and is moved downward under the force of the spring when the boot is removed. This downward movement is used to strike the latch lever so as to release the ski brake.

On account of this construction the sole clamping part can traverse the predetermined distance, independently of the release mechanism of the sole clamp, after the ski boot has pulled out from under the clamp. This embodiment is also especially suitable when incorporation of the ski brake in the release mechanism is either not possible or not desired.

Furthermore, it is possible to simultaneously arrange for the height of the second sole clamping part to be adjustable. This is done by means of a screw which is threaded into the second clamping part and slideably supported in the first pivoted part for vertical movement relative thereto through the predetermined distance. This is readily achieved by providing a plain cylindrical thread free portion on the screw which is slidably supported in a projection on the pivoted part. The spring is preferably interposed between the underside of the projection and the step between the thread free and threaded portions of the screw.

In a ski safety binding having a release mechanism which incorporates a release spring guide rod the movement of this guide rod can be used for the purposes of the invention. This is done by arranging that the guide rod moves in the same direction both on movement of the sole clamp through the predetermined distance and on upward movement of the sole clamp when the release point of the binding is exceeded. This movement of the guide rod is used to release the movable arm of the ski brake. One way of achieving this is by providing an abutement on the guide rod which coacts with a movable member which carries the latch hook for the ski brake.

In all the various embodiments the ski brake is usefully provided with two braking arms which extend along either side of the ski, which are pivotable about a transverse axis, and are spring loaded towards their deployed position. The movable arm is usefully connected to the shaft which joins both the arms of the brake. The movable arm can actually comprise two independent arms spaced apart from each other and connected by a part which engages the latch lever.

The invention will now be described by way of example only and with reference to the accompanying drawings in which is shown:

FIG. 1 a partly sectioned side view of a first embodiment of a ski safety binding and ski brake in accordance with the invention.

Figure 2:
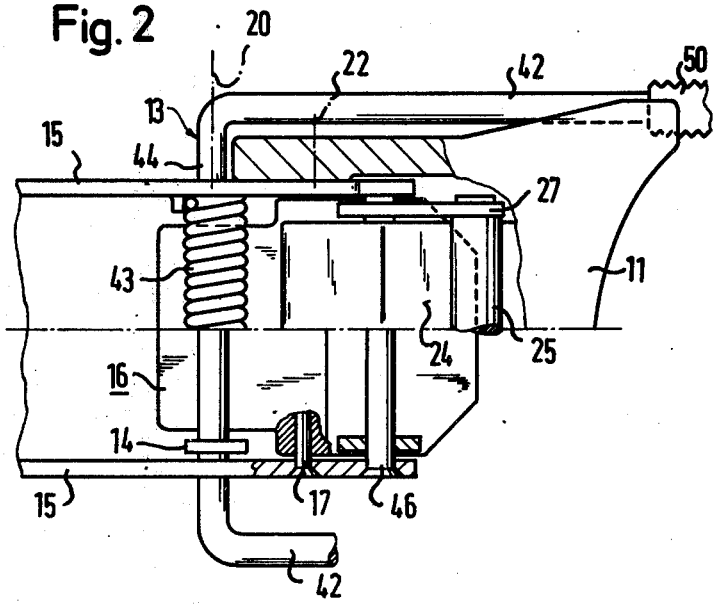

FIG. 2 a partly sectioned and broken away plan view of the embodiment of FIG. 1.

Figure 3:
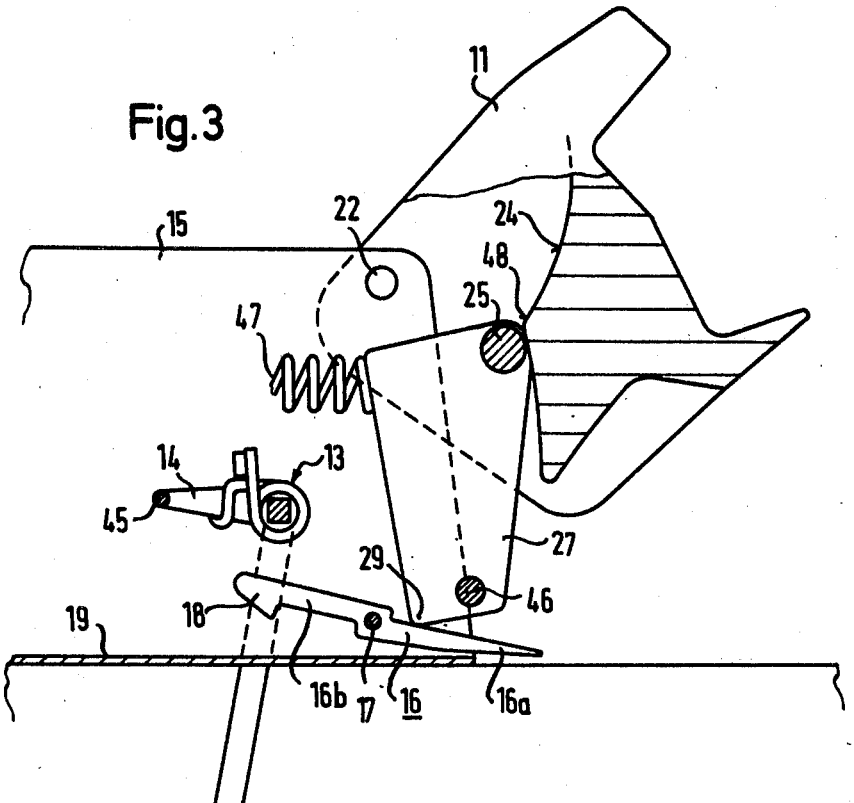

FIG. 3 a similar view to FIG. 1 but showing the ski safety binding and ski brake after an upward heel release.

Figure 4:
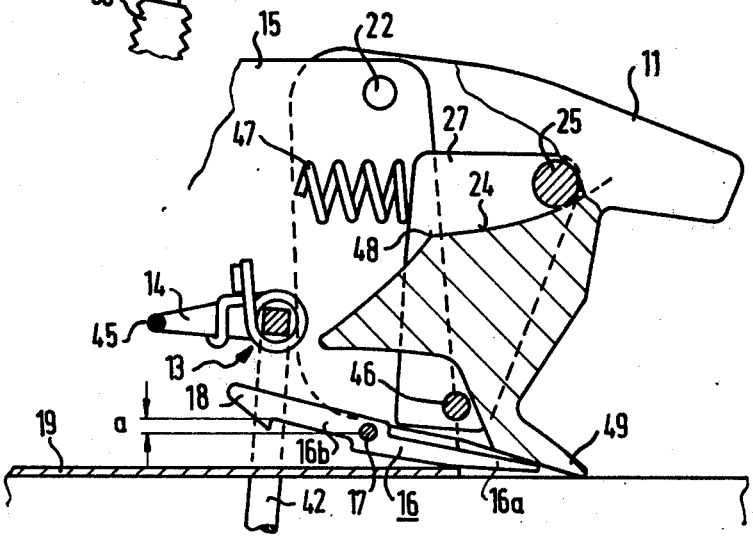

FIG. 4 a similar view to FIG. 1 of the same ski safety binding and ski brake after a forward or sideways release of the ski boot.

FIG. 5 a partly sectioned side view of a further embodiment.

FIG. 6 a partly sectioned view of the ski safety binding and ski brake of FIG. 5 as seen from behind.

Figure 7:
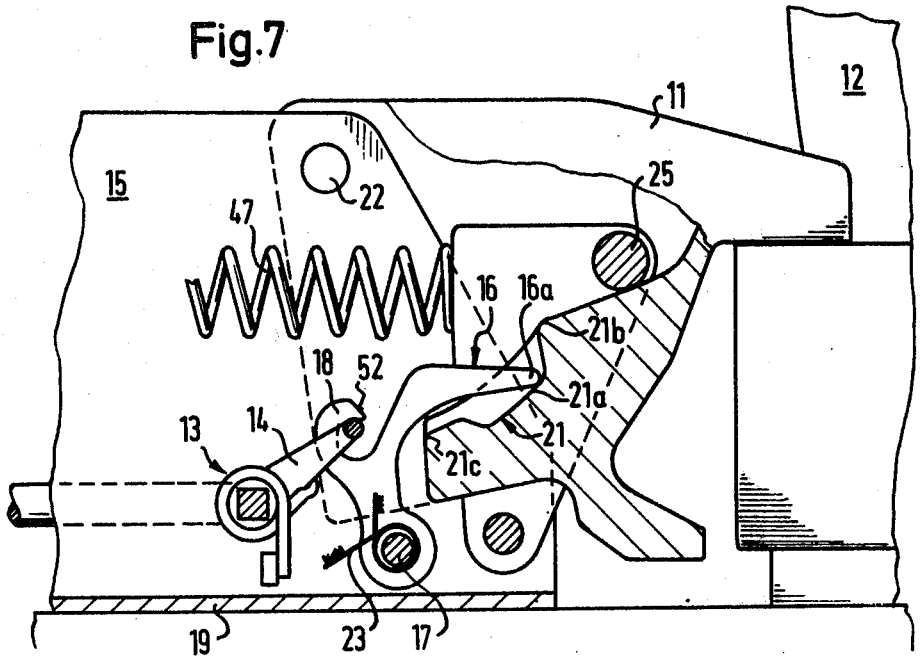

FIG. 7 a partly sectioned side view of a similar embodiment to that of FIG. 5.

Figure 8:
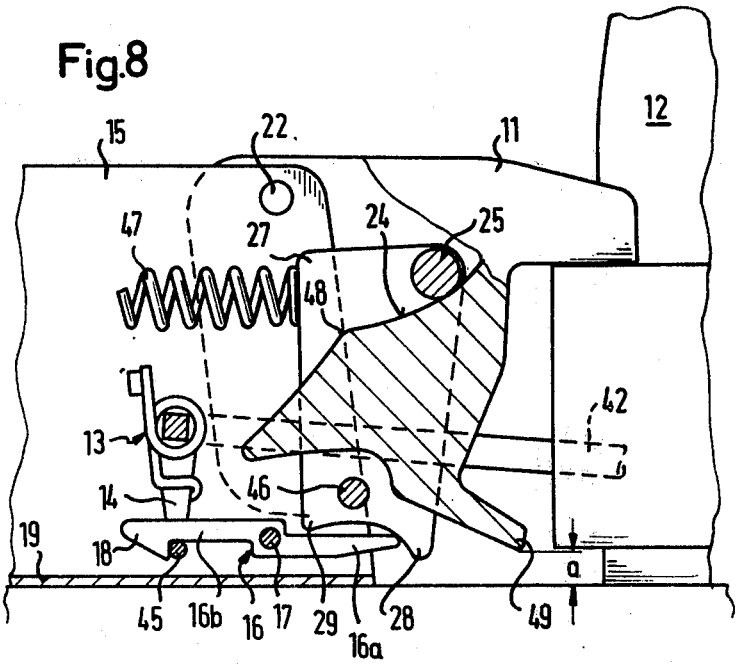

FIG. 8 a partly sectioned side view of a further embodiment of a ski safety binding and ski brake in accordance with the invention.

Figure 9:
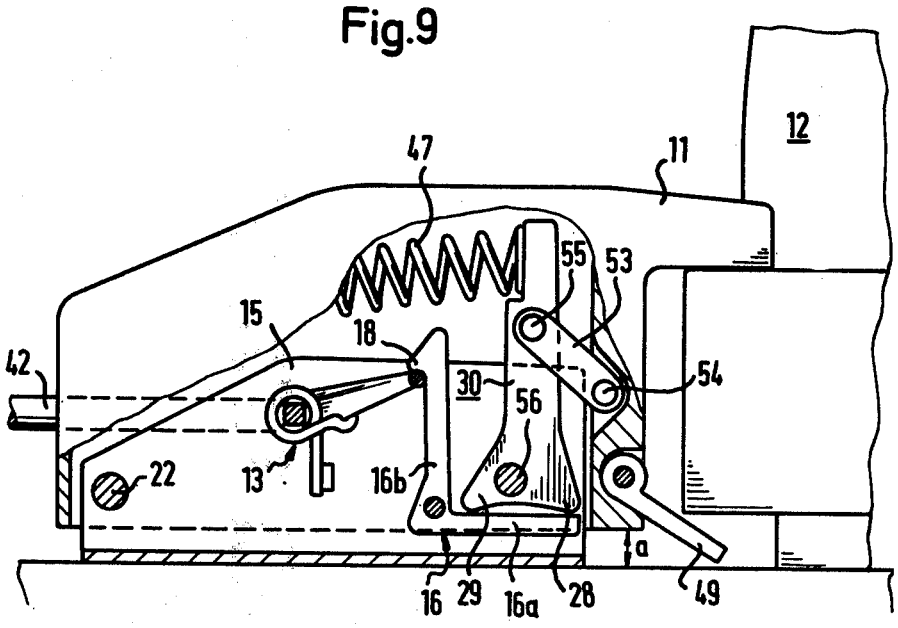

FIG. 9 an embodiment of a ski safety binding and ski brake in accordance with the invention incorporating a toggle lever mechanism as seen in partly sectioned side view.

Figure 10:
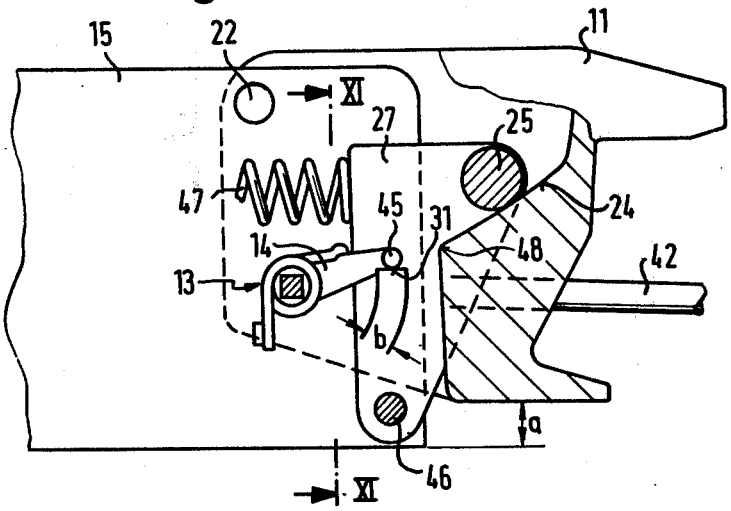

FIG. 10 a partly sectioned side view of a further embodiment of a ski safety binding and ski brake in accordance with the invention.

Figure 11:
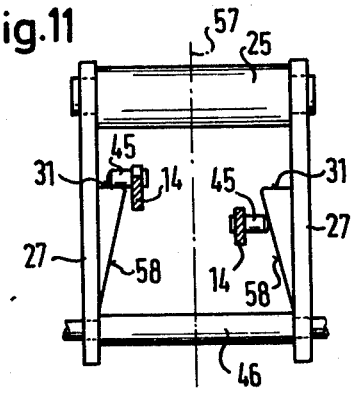

FIG. 11 a view in the direction of the arrow on the line XI—XI of FIG. 10 showing cooperating parts of the ski brake whereby two different positions of the ski brake are illustrated to left and right of the central axis.

Figure 12:
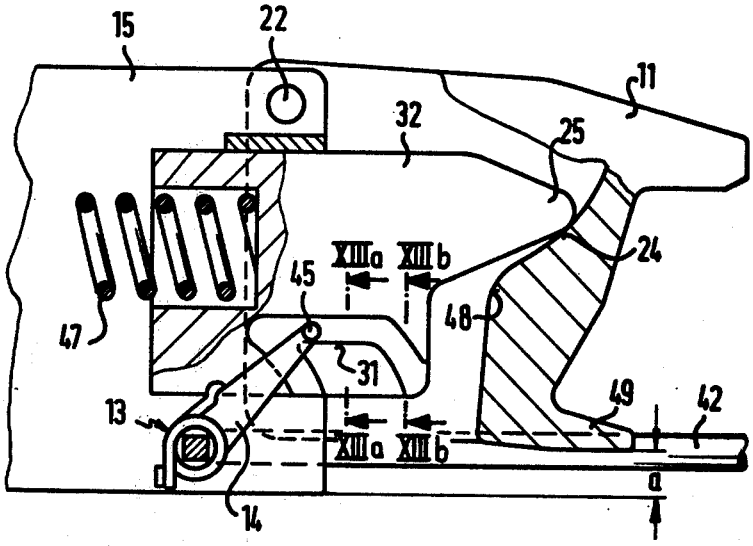

FIG. 12 is a partly sectioned side view of a similar embodiment to that shown in FIGS. 10 and 11.

Figure 13:
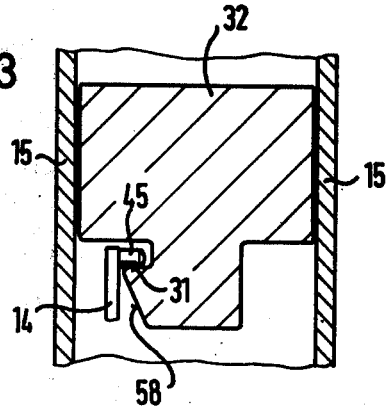

FIG. 13 sections taken on the lines XIII*a*—XIII*a* and XIII*b*—XIII*b* of FIG. 12 shown to the left and right of a vertical central axis respectively.

Figure 14:
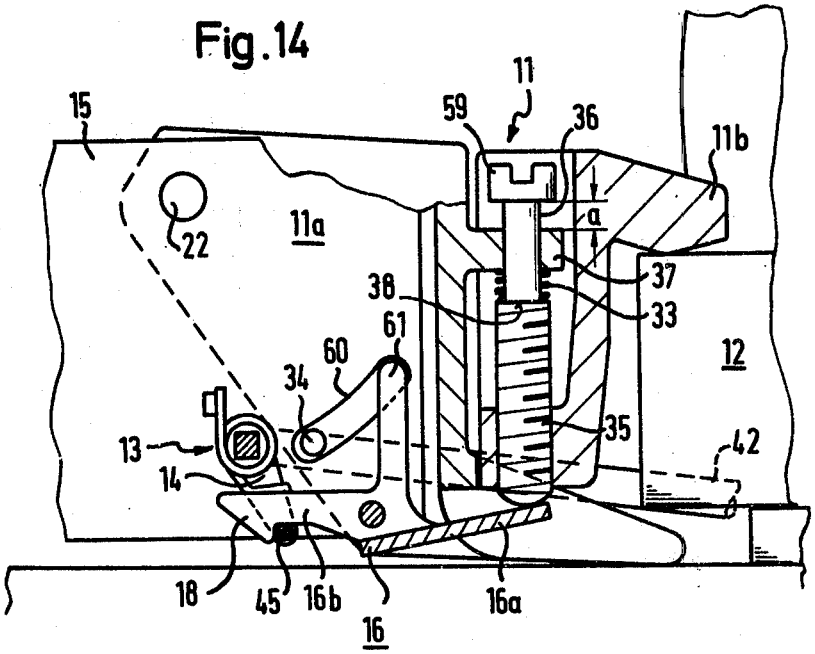

FIG. 14 a partly sectioned view of an embodiment of a ski safety binding and ski brake in accordance with the invention in which the release mechanism for the ski brake operates independently from the mechanism for releasing the binding.

Figure 15:
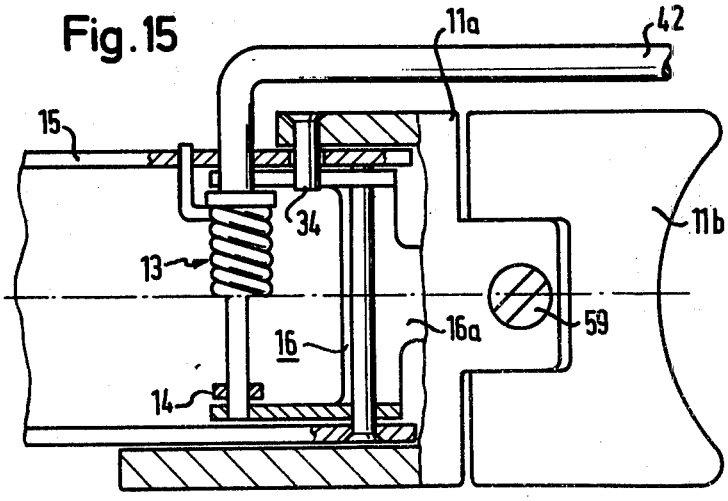

FIG. 15 a partly sectioned plan view of the subject of FIG. 14.

Figure 16:
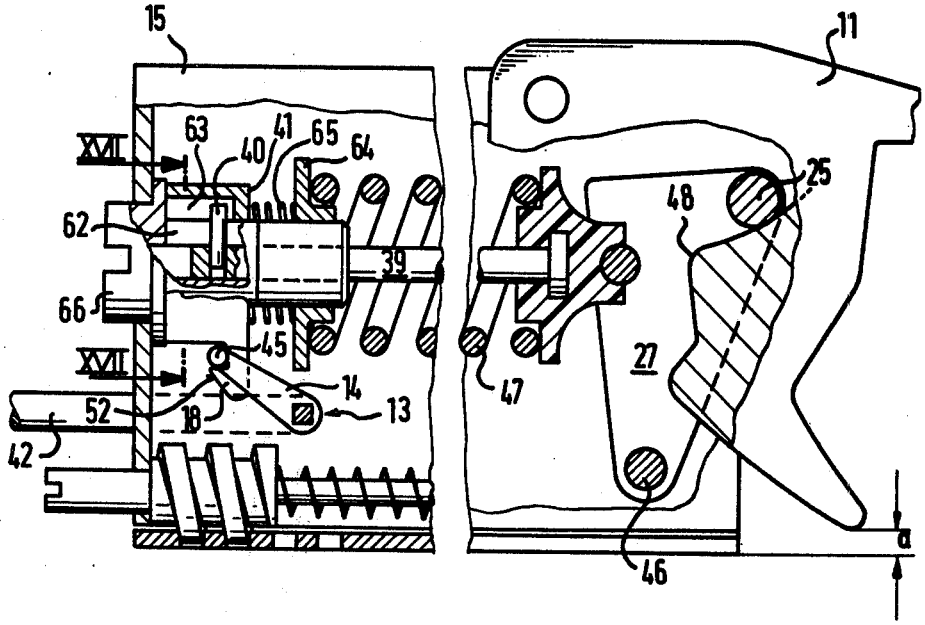

FIG. 16 a partly sectioned side view of an embodiment of a ski safety binding and ski brake in accordance with the invention which incorporates a spring loaded guide rod.

Figure 17:
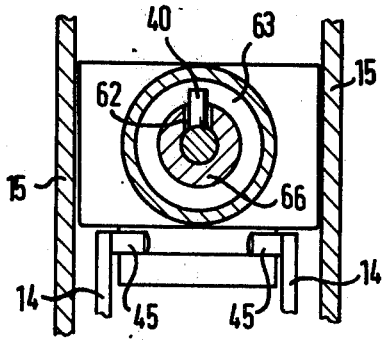

FIG. 17 a section on the line XVII—XVII of FIG. 16.

In all the embodiments the same reference numerals are used to identify corresponding components. To simplify the description all constructional elements will only be described the first time they arise in connection with one of the embodiments.

Referring now to FIGS. 1 and 2 a sole clamp is pivotally mounted for rotation in an upward direction about a transverse pivot axis 22 of a binding housing 15. The binding housing 15 has a base 19 by means of which it is fastened to the ski either directly or by way of a fastening which is spring biased from the rear(not shown but well known per se). FIG. 1 actually indicates a heel safety binding as indeed do all the other embodiments herein described.

Inside the sole clamp 11 there is a cam track 24 associated with the release mechanism which cooperates with a roller follower 25 itself fastened to a pivoted carrier 27 which can rotate about a transverse pivot axis 46 fastened to the housing 15. The carrier is spring loaded from behind by a release spring 47 whose compression can be adjusted from outside of the binding housing to control the release setting. In FIG. 1 a ski boot 12 is in place in the binding and the sole clamp 11 exerts a downward force on the sole of the boot by means of a part which presses downwardly on a lip around the heel of the boot.

In accordance with the invention the sole clamp 11 is so formed that if the ski boot is drawn out sideways or in the forward direction the sole clamp can pivot downwardly by a further predetermined distance 'a'. This is achieved by the provision of a further distance A on the cam track outside of the normal working region on which the follower 25 slides during travel of the sole clamp through the further distance 'a'. The sole clamp is thus spaced by a distance 'a' from the end stop, in this case the surface of the ski, in the direction of closure of the binding.

The normal release process takes place when an excessive upward force, applied by the ski boot 12 to the sole clamp, results in a counter clockwise rotation of the sole clamp which causes rearward movement of the follower along the cam track against the force of the release spring 47 until the apex 48 of the cam track is reached. The path along the cam track up to the apex 48 corresponds to the desired vertical resilience of the binding. After the point 48 has been exceeded the follower 25 holds the sole clamp 11 in the open position until the ski boot is once more newly introduced into the sole clamp and pressure of the heel on the part 49 closes the binding.

A ski brake 13 is also provided in accordance with the invention and comprises two braking arms 42 arranged to either side of the ski at opposite ends of a shaft 44 which passes transversely through the binding housing.

The braking arms can be provided at their ends with any desired special braking devices 50. An arm 14 is also connected to the shaft 44 and thus pivots simultaneously with the shaft and the braking arms on movement thereof about the pivot axis 20 of the shaft.

In the inoperative position of the braking arms, shown in FIG. 1, the arm 14 extends downwardly and an attached part 45 grips under a latch hook 18 on a lever arm 16*b* of a latch lever 16 which can pivot about a transverse pivot 17. The other lever arm 16*a* of the latch lever, which is constructed generally as a flat plate, extends forwardly under the carrier 27 to a position underneath a flat surface 51 of the sole clamp 11. The space between the lever arm 16*a* and the surface 51 is considerably less than the predetermined distance 'a'.

The carrier 27 has a projection 29 at its extremity to the left of and underneath its pivot point 46 which is also spaced by a predetermined amount from the lever arm 16*a* of the lever 16.

The manner of operation of the embodiment of FIGS. 1 and 2 is as follows:

In the position shown in FIGS. 1 and 2 the latch hook 18 engages the arm 14 and holds the braking arms 42 in their inoperative position. This normal position of the lever 16 is secured either by a corresponding light spring biasing the lever 16 in the counterclockwise direction or by an appropriate shaping of the latch hook 18. The clearance of the projection 29 from the lever arm 16*a* is chosen to be of such a size that pivotal movement of the carrier 27 corresponding to movement of the follower up to the apex 48 of the cam track does not allow the projection to contact the lever 16. Only when the apex 48 is reached or exceeded does the projection 29 press the lever arm 16*a* downwardly so that the latch hook is removed out of engagement with the part 45. When this happens the operating spring 43 for the ski brake drives the ski brake into its operating position as can be seen from FIG. 3. Simultaneously the sole clamp 11 snaps into its open position, as is also shown in FIG. 3.

If the ski boot should be released at the front binding and slide either forwardly or to either side out of the sole clamp 11 then the sole clamp 11 moves downwardly by the amount 'a' under the influence of the follower 25 on the cam track 24.

When this happens the surface 51 of the sole clamp presses on the lever arm 16 which then likewise rotates in the clockwise direction and releases the latch hook 18 from the part 45 to free the ski brake so that the brake is driven into its braking position as can be seen from FIG. 4. The sole clamp 11 remains in the locked position of FIG. 4 and must be opened by hand to allow the ski boot to be re-engaged with the binding.

In the embodiment of FIGS. 5 and 6 a groove like depression 21 is made in the cam track 24 and the base of the depression acts as a cam track 21 for the projection 16*a* of the latch lever 16 which, as before, rotates about a transverse axis 17 beneath the cam track 21. The latch lever 16 once more locks the movable arm 14 of the ski brake by means of a latch hook 18.

The cam track 21 has a circular portion 21*a* whose center of curvature is the middle of the transverse pivot 22 of the sole clamp 11 and also two end portions 21*b* and 21*c* which drop away from the circular portion. The track portion 21*a* and the lever 16 are so arranged relative to each other that when the projection 16*a* contacts the track portion 21*a* the lever 16 is moved into the latched position of FIG. 5. The length of the circular track 21*a* is such that the latch lever 16 remains in the FIG. 5 position until the follower 25 has reached the apex 48 of the cam track 24. Only after this does the depression 21*c* in the cam track 21 reach a position in which the latch hook 18 releases the arm 14 and the ski brake following rotation of the lever 16 in the clockwise direction.

The same manner of operation occurs when the ski boot is drawn either forwardly or sideways out of the sole clamp 11 because then the sole clamp 11 pivots in a clockwise direction through the distance 'a' which allows the projection 16*a* to drop into the depression 21*b* of the cam track 21.

As can be seen especially clearly in FIG. 6 this embodiment allows the latch lever and the groove like depression 21 to be of relatively narrow construction. In contrast the roller follower 25 is relatively wide so that it bridges the depression 21 and remains in engagement with the cam track 24.

The part 45 can be spring loaded or constructed as a spring in order that the ski brakes can be engaged by hand over the latch hook 18 into the latched position. The inclined face on the back of the latch hook 18 makes it possible for the part 45 to spring back into engagement with the latch hook 18.

FIG. 7 shows an inversion of the embodiment of FIGS. 5 and 6 in which the end portions 21*b*,21*c* of the cam track 21 rise instead of dropping away as per FIG. 5. In this way, when the projection 16*a* runs onto either of the end portions 21*b* or 21*c*, the latch lever 16 is forced to rotate in the counter clockwise direction. A spring 23 preloads the lever in the opposite direction so that the latch lever returns automatically to its operative position following binding release and operation of the ski brake.

The advantage of this embodiment is that the inclined face 52 in the vicinity of the latch hook 18 makes it possible for the ski brake to snap back into the latched position by simple hand operation because the projection 16*a* temporarily lifts out of engagement with the cam track 21.

In the embodiment of FIG. 8 the pivoting carrier 27 has two projections 28 and 29 on its underside. Projection 29 has the same function as the similarly numbered projection of the embodiment of FIG. 1. The additional projection 28 takes over the role of pivoting the latch lever 16 in the clockwise direction thereby releasing the ski brake 13 on downward movement of the sole clamp 11 through the distance 'a'.

This occurs because the carrier 27 also moves in the clockwise direction as the sole clamp moves downwardly through the distance 'a' and this movement of the carrier is utilized via the projection 28 to release the ski brakes.

The embodiment of FIG. 9 shows a sole clamp provided with a toggle lever mechanism. The sole clamp 11 itself comprises a toggle lever which carries a toggle pivot at 54. Another toggle lever 53 extends from the toggle pivot 54 to another toggle pivot 55 on a lever arm 30 which is spring biased by the spring 47 and which can pivot downwardly about the transverse axis 56.

In the position illustrated the spring 47 presses the sole clamp 11 downwardly into the closed position. As soon as the pivots 22, 55, 54 are in line with each other the release point of the binding has been reached and the binding releases.

Projections 28, 29 are provided on the lever arm 30 to both sides of its pivot axis 56 which cooperate with the cranked latch lever 16. Projection 29 operates the latch lever 16 at that moment when the release point of the toggle lever arrangement is exceeded. The other projection 28 comes into engagement with the lever 16 as soon as the sole clamp 11 has traversed the distance 'a' following pulling out of the boot from under the clamp.

In the embodiment of FIG. 9 the lip 49 on which the user treads to reengage the binding is connected to the sole clamp about a transverse axis.

The projections 28, 29 of the embodiments of FIGS. 1, 8 and 9 need not necessarily be formed as parts of the carrier 27 or the lever arm 30.

A release could as easily be brought about through movement of the pivots 46 or 56 respectively. In this case, the necessary projections would be provided on the pivots on the assumption that the pivots are connected to rotate with the carrier of lever arm. In similar manner rotation of the pivot 22 can be used to release the ski brake.

In the embodiments of FIGS. 10 and 11 supports 31 are provided on the internal vertical sides of the carrier 27 whose width is to be so dimensioned that the movable arm 14 of the ski brakes 13 which engages the supports 31 is released when the sole clamp has moved clockwise through the distance 'a' and also when the follower 35 has exceeded the apex 48 of the cam track 24. Between these two operative positions the ski brakes remain in their inoperative position and do not therefore move.

FIG. 11 shows, to the left of central axis 57, the latched position of the movable arm 14 while on the right hand side there is illustrated the operative position of the ski brakes.

By choosing suitable elastic characteristics of the individual movable arms 14 projections 45 provided at the ends of the arms 45 can slide up the inclined faces 58 on movement of the ski brake and finally snap into their inoperative position on the support faces 31.

In all the previous embodiments the movable arms 14 can either comprise two individual arms such as can be seen in FIG. 11 or the ends of the arms 14 can be connected directly together through the rod 45. This however would not be useful in FIG. 11 because it would prevent the automatic springing into position of the arms.

FIGS. 12 and 13 show a similar embodiment to that of FIGS. 10 and 11 except that a piston 32, displaceable in the longitudinal direction of the ski, is provided instead of the pivoted carrier 27 and its associated pivot 46. The piston 32 carries the follower 25 at its foremost point.

The projections 45 at the ends of the arms 14 once more contact support faces 31 on the piston 32 off which they slide as soon as one or other of the release positions is reached. The inclined face 58 of FIG. 13 once more makes it possible to align the ski brakes 13 in their inoperative position and subsequently to maintain them in this position.

FIGS. 14 and 15 illustrate an embodiment in which the sole clamp 11 comprises a pivoted part 11*a* which pivots about the pivot 22 which lies transversely of the binding housing an an associated part 11*b* which actually engages the lip of the ski boot sole and whose height can be adjusted. The release mechanism in this embodiment can be of any desired kind and for this reason it is not shown in the drawing.

The thread free cylindrical portion of a bolt 35 passes vertically through a horizontal projection 37 carried by the pivoted part 11*a* of the sole clamp and is slidably displaceable in the vertical direction.

A coil spring 33, interposed in the space between the underside of the projection and the threaded part of the bolt 55 surrounds the thread free portion of the bolt and is sufficiently strong that it is capable of actuating the latch lever 16. The bolt 35 has a vertical range of movement which is the same as for the previous embodiments namely 'a'.

The threaded part of the bolt 35 is screwed into a corresponding threaded bore in the part 11*b* of the sole clamp. The head 59 of the bolt is accessible from outside the binding so that by rotating the bolt the height of the sole clamp part 11*b* can be adjusted relative to the pivoted part 11*a*. The bolt 35 however always has the same position relative to the lever arm 16*a*.

The bottom end of the bolt 35 engages the lever arm 16*a*. When a ski boot is in position the clamp part 11*b* together with the bolt 35 is pressed into the position of FIG. 14. If the ski boot pulls out of the sole clamp either forwardly or to either side thereof then the spring 33 moves the bolt 35 and also the sole clamp part 11*b* downwardly which results in the latch lever 16 rotating in a clockwise direction and the latch hook 18 being released from the movable arms 14. The ski brake is thus brought into operation.

In order that the ski brake can also be released by an upward movement of the heel of the ski boot an abutment 34 is fastened to the pivoted part 11*a* which can slide in a curved slot 60 of the housing. As soon as the release point is exceeded the abutment 34 contacts a further arm 61 of the latch lever 16 which is so arranged that it then likewise rotates in the clockwise direction and releases the ski brake 13.

The abutment 34 has the form of a bolt which extends through the side wall of the housing 15. The uppermost end position of the bolt 35 relative to the projection 37 can be determined by a suitable abutment not shown rather than by the binding of the coil spring 33 as would be the case in the embodiment shown.

Turning finally to FIGS. 16 and 17 there is shown an embodiment in which the movement of a release spring guide rod 39 is used to release the ski brake. It is also the case with this embodiment that the sole clamp 11 can move downwardly through a distance 'a' after the ski boot has pulled out. This movement is connected with the clockwise rotation of the pivoted carrier 27 which is followed by the guide rod 39 for the release spring 47. The compression in the release spring is adjustable by means of a screw 66 which is accessible from outside the housing. In this embodiment it is exceptionally important that the pivoted carrier 27 pivots further forwardly after the apex 48 of the cam track has been exceeded i.e. that the release spring guide rod 39 also moves forwards.

On a rearward movement of the pivoted carrier 27 (corresponding to lifting of the sole clamp in an upward direction) the guide rod 39, together with the sideways projecting abutment 40, at its one end, slides inside the adjusting screw 66. The abutment 40 projects through a slot 62 in the side of the adjusting screw 66 into a hollow space 63 provided within a displaceable sleeve 41. The sleeve is prevented from rotating by side faces which bear on the side plates 15 of the walls of the binding housing; this can be seen in FIG. 17.

At its underside the sliding sleeve is provided with a latch hook 18 which, in the position of FIG. 16, secures the ski brake in the inoperative position. The hollow space 63 in the sliding sleeve 41 is so arranged that the abutment 40 can slide freely within the space 63 throughout the normal range of movement of the sole clamp 11. However, when the sole clamp has travelled through the distance 'a', or after the follower 25 has moved past the apex 48, the abutment 40 strikes the end of the slidable sleeve 41 and moves the sleeve to the right. This releases the latch hook from the projections 45 of the movable arm 14 of the ski brake 13 so that the ski brake is released.

Thus it is also the case with this embodiment that during normal kinds of operation of the ski binding the ski brake does not move at all but is however released after either the release point of the binding has been reached or the ski boot has slid forwardly or sideways out of engagement with the sole clamp.

Rotation of the adjusting screw 66 to change the compression in the release spring 47 is made possible because the hollow space 63 is annular in shape and thus allows the abutment 40 to rotate with the adjusting screw.

Finally a weak spring 65 is interposed between the end of the slidable sleeve and the spring plate 64 which is threaded onto the adjusting screw and which supports the release spring 47. The weak spring serves to spring bias the slidable sleeve into the latched position. An inclined face 52 on the latch hook 18 once more makes it possible for the ski brake to be snapped back by hand into its inoperative position.

I claim:

1. In combination: a safety ski binding and a ski brake, the ski brake incorporating at least one brake arm pivotable from an inoperative position to an operative braking position, said combination further comprising a sole clamp pivotally arranged on a base member for securing in a closed position of the sole clamp a ski boot on a ski by means of a clamping force exerted in the closure direction of the sole clamp and for releasing the ski boot by opening movement on the occurrence of excessive forces, means for locking the ski brake in said inoperative position, spring means for deploying the ski brake into said operative position following release of the ski boot, means permitting movement of the sole clamp through at least a predetermined minimum distance beyond said closed position, and mechanism including a lever provided between the sole clamp and the ski brake and responsive on movement of the ski boot out of the binding to both opening movement of the sole clamp and movement of the sole clamp through said predetermined distance to release the ski brake.

2. The combination according to claim 1 in which said binding has a housing and in which said lever is pivotably mounted on the binding housing and extends between the sole clamp and a movable arm of the ski brake, the lever including means for locking the movable arm and thus the ski brake in an operative position, and means for pivoting the lever on movement of the sole clamp through said predetermined distance to release said movable arm.

3. The combination according to claim 2 in which the lever is directly operated by the movement of the sole clamp through said predetermined distance to release said movable arm.

4. The combination according to claim 3 in which the lever has two arms, one of which extends beneath a part of the sole clamp and the other of which is provided with a latch hook adapted to engage behind the movable arm of the ski brake.

5. The combination according to claim 3 in which the lever is generally flat.

6. The combination safety binding according to claim 3 and in which the lever is arranged near the base of the binding housing.

7. The combination according to claim 3 and in which the lever extends in its normal position substantially parallel in the base of the binding housing and to the surface of the ski.

8. The combination according to claim 3 and in which the ski brake is pivotally mounted above the lever.

9. The combination according to claim 8 and in which the pivot point of the ski brake is located above the latch hook and the movable arm extends generally downwardly from the pivot point.

10. The combination according to claim 2 in which the lever cooperates with a cam track movable with the sole clamp, the cam track having a central track portion related to a predetermined range of movement of the sole clamp and corresponding to a position of the lever in which said movable arm is secured and further track portions to either side of the central track portion related to movement of the sole clamp beyond the respective limits of said predetermined range and corresponding to a position of the lever in which said movable arm is released.

11. The combination according to claim 10 in which said central track portion is of circular curvature and whose center of curvature is coincident with the said pivot axis of the sole clamp and in which the further track portions are inclined relative to the central track portion whereby to cause releasing movement of said lever.

12. The combination according to claim 11 in which the further track portions rise away from the central track portion and in which a spring biases the said lever towards the cam track.

13. The combination according to claim 10 in which the said lever is pivotally secured about a pivot beneath the lever.

14. The combination according to claim 10 in which the latch hook and the lever part engaging the cam track are located on the same side of the pivot point.

15. The combination according to claim 10 in which the means of exerting a clamping force on the boot comprises a spring loaded follower bearing on a release cam track on the sole clamp and in which the cam track associated with said lever is incorporated as a profiled groove within said release cam track.

16. The combination according to claim 15 in which the part of said lever engaging the cam track comprises a narrow projection adapted to slide in said groove and in which the said spring loaded follower bearing on the release cam track bridges the groove.

17. The combination according to claim 15 in which the part of said lever engaging the cam track is located beneath said spring loaded follower.

18. The combination according to claim 2 in which the means for exerting a clamping force on the boot comprises a release cam track on the sole clamp, and a follower mounted on a pivoted carrier and bearing on the release cam track, and in which the pivoted carrier further includes two projections, one of said projections being operative to move said lever to release the ski brake on opening movement of the sole clamp after the release point of the binding has been reached, and the other being likewise operative following movement of the sole clamp through said predetermined distance.

19. The combination according to claim 18 in which said lever has two arms one of which extends beneath the projections on the pivoted carrier and the other of which is provided with a latch hook capable of engaging behind the movable arm of the ski brake.

20. The combination according to claim 18 in which said lever is of generally flat construction.

21. The combination according to claim 18 in which said lever is disposed near to the base of the binding housing.

22. The combination according to claim 18 in which said lever in its position corresponding to the inoperative position of the ski brake extends generally parallel to the surface of the ski.

23. The combination according to claim 18 in which said ski brake is pivotally mounted above the lever.

24. The combination according to claim 19 in which the latch hook of said lever is located beneath the pivot point of said lever and is engageable with a downwardly extending movable arm of the ski brake.

25. The combination according to claim 2 in which said means for exerting a clamping force on the sole of the boot comprises a releasable toggle mechanism, and in which the toggle lever is provided with two projections cooperable with the said lever to release the ski brake, the one projection being operative on opening movement of the sole clamp past the release point of the sole clamp and the other being operative following movement of the sole clamp through said predetermined distance.

26. The combination according to claim 25 in which said lever is a cranked lever.

27. The combination according to claim 2 in which said sole clamp comprises a first part pivotally mounted on the binding, a second part contactable with the ski boot and vertically movable through said predetermined distance relative to the first part following release of the ski boot, and a spring for effecting said movement and wherein both movement of the second part through said predetermined distance and pivotal movement of the first pivoted part following the release point of the binding being exceeded are separately capable of operating said lever to release the ski brake.

28. The combination according to claim 27 comprising a screw threaded into said second part, and having a plain shank and a threaded portion, and in which said second part of the sole clamp is slidably supported relative to said first part for movement through the predetermined distance on the plain shank.

29. The combination according to claim 28 in which the plain shank of said screw passes through a projection on the first part.

30. Ski safety binding according to claim 29 in which the spring between said first and second parts is interposed between the underside of the projection and the threaded portion of the screw.

31. In combination: A ski safety binding and a ski brake, the ski brake incorporating at least one brake arm pivotable from an inoperative position to an operative braking position, said combination comprising a sole clamp pivotally arranged on a base member, a release mechanism including a spring guided on a guide rod for securing in a closed position of the sole clamp, a ski boot on a ski by exerting a clamping force in the closure direction of the sole clamp and for releasing the ski boot by opening movement of the ski clamp on the occurrence of excessive forces, means for permitting movement of the sole clamp through a predetermined minimum distance beyond said closed position, a latch member for locking the ski brake in said inoperative position and associated with the release mechanism, and means for producing movement of the latch member in a common direction following both opening movement of the sole clamp and movement of the sole clamp through said predetermined distance to release the ski brake, and spring means for deploying the ski brake into said operative position following release of the ski boot from the binding.

32. The combination according to claim 31 in which said guide rod is provided with an abutment which is cooperable with a movable member carrying the latch member.

33. In combination: a safety ski binding and a ski brake, the ski brake incorporating at least one brake arm pivotable from an inoperative position to an operative braking position, said combination further comprising a sole clamp pivotally arranged on a base member for securing in a closed position of the sole clamp a ski boot on a ski by means of a clamping force exerted in the closure direction of the sole clamp and for releasing the ski boot by opening movement on the occurrence of excessive forces, means for locking the ski brake in said inoperative position, spring means for deploying the ski brake into said operative position following release of the ski boot, means permitting movement of the sole clamp through at least a predetermined minimum distance beyond said closed position, and mechanism responsive on movement of the ski boot out of the binding to both opening movement of the sole clamp and movement of the sole clamp through said predetermined distance to release the ski brake.

34. The combination according to claim 33 in which said ski brake is provided with two braking arms disposed one to each side of the binding, the arms being pivotable about a common pivot axis disposed transversely of the binding.

35. The combination according to claim 34 in which the two braking arms are connected together by a shaft and a further arm means is provided on said shaft and is cooperable with said mechanism for securing and releasing the ski brake.

36. The combination according to claim 35 and in which said arm means comprises a pair of spaced apart individual arms connected together by a part engageable with a latch hook of said mechanism.

37. In combination: a safety ski binding and a ski brake, the ski brake incorporating at least one brake arm pivotable from an inoperative position to an operative braking position, said combination comprising a sole clamp pivotally arranged on a base member, a release cam track arranged on the sole clamp and a follower bearing on the release cam track, means supporting the follower for movement generally in the longitudinal direction of the ski, and means resiliently urging the follower into engagement with the release cam track for securing, in a closed position of the sole clamp, a ski boot to a ski by means of a clamping force exerted in the closure direction of the sole clamp and for releasing the ski boot on the occurrence of excessive forces; said means supporting the follower being provided with support surfaces on which a member movable with the ski brake rests, the width of said support surfaces being chosen so that following either release of the binding or travel of the sole clamp through said predetermined distance the member moves off said support surfaces for releasing the ski brake.

* * * * *